United States Patent [19]

Tomé, Jr.

[11] Patent Number: 4,948,262

[45] Date of Patent: Aug. 14, 1990

[54] ROTARY MIXING AND STRAINING APPARATUS

[76] Inventor: Floyd Tomé, Jr., 106 Julian Ave., Marietta, Ohio 45750

[21] Appl. No.: 369,971

[22] Filed: Jun. 22, 1989

[51] Int. Cl.[5] ..... B01F 5/12; B01F 7/18; B01F 7/32

[52] U.S. Cl. ..... 366/129; 366/265; 366/309; 366/328; 366/329; 366/343

[58] Field of Search ..... 366/129, 130, 263, 265, 366/279, 329, 325, 328, 343, 344, 345, 264, 605, 309; 210/359, 402, 497.01; 416/76, 227 R, 231 A, 181; 241/97, 277, 278 A, 46.17

[56] References Cited

U.S. PATENT DOCUMENTS

| | | | |
|---|---|---|---|
| 938,738 | 11/1909 | Bauer | 366/279 X |
| 1,031,666 | 7/1912 | Richmond | 366/265 |
| 1,689,103 | 10/1928 | Bendixen | 366/329 X |
| 2,258,830 | 10/1941 | Vollrath | 366/309 |
| 2,469,649 | 5/1949 | Hunter et al. . | |
| 2,518,196 | 8/1950 | Solomon . | |
| 2,635,860 | 4/1953 | McLeod | 366/265 |
| 2,718,385 | 9/1955 | Greblick et al. | 366/264 X |
| 2,791,407 | 5/1957 | Harrison | 366/328 |
| 2,890,028 | 6/1959 | Lauffer | 416/76 X |
| 3,170,638 | 2/1965 | Burton | 366/265 X |
| 3,279,895 | 10/1966 | Howe | 366/328 X |
| 3,415,650 | 12/1968 | Frame et al. | 366/328 X |
| 4,332,482 | 6/1982 | Engler | 366/130 |
| 4,472,063 | 9/1984 | Eickelmann | 366/129 |

FOREIGN PATENT DOCUMENTS

| | | | |
|---|---|---|---|
| 60-78630 | 5/1985 | Japan | 366/279 |

*Primary Examiner*—Harvey C. Hornsby
*Assistant Examiner*—Scott J. Haugland

[57] ABSTRACT

A rotary mixing and straining apparatus (10) for liquids (100) including a shaft member (16) secured on one end to a rotary power tool (15) and equipped on the other end with a mixing head unit (13) including a generally cylindrical open framework member (20) surrounded by a screen member (40) whereby the liquid (100) is forced outwardly through the screen member (40) by centrifugal forces and recirculated through the open top of the framework member (20).

3 Claims, 1 Drawing Sheet

FIG. 1.
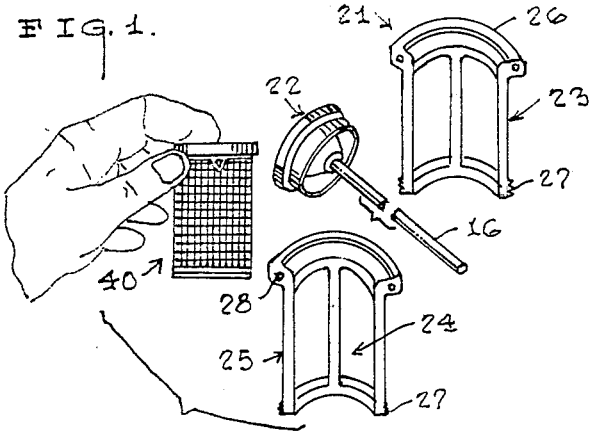
FIG. 4.
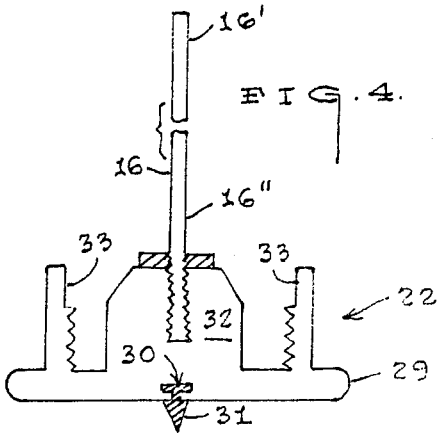
FIG. 2.
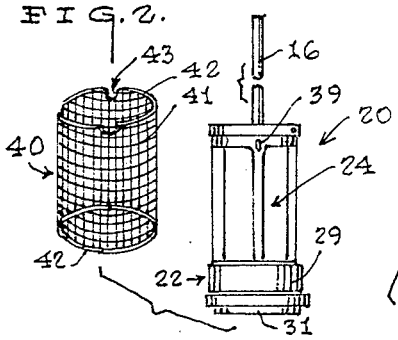
FIG. 5.
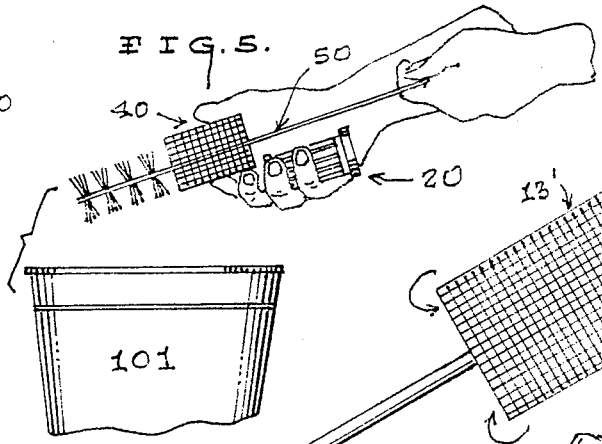
FIG. 3.
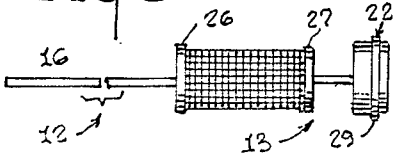
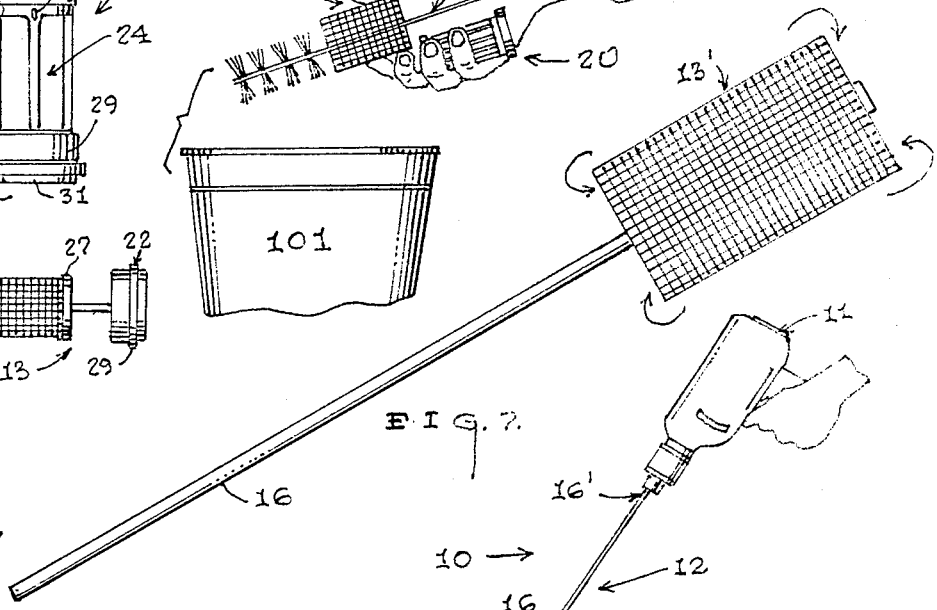
FIG. 7.
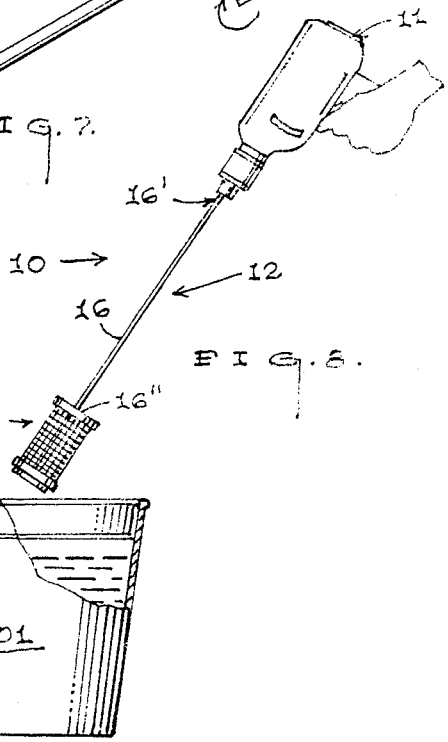
FIG. 8.
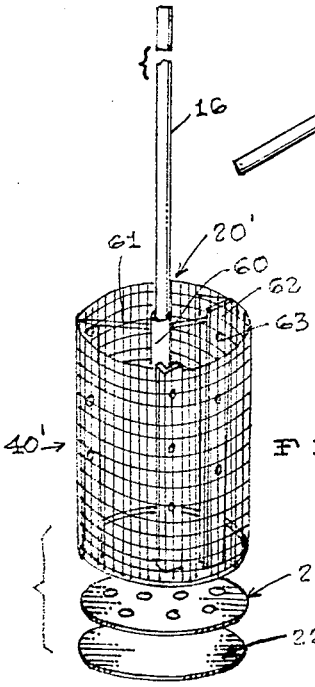
FIG. 6.

ROTARY MIXING AND STRAINING APPARATUS

TECHNICAL FIELD

The present invention relates generally to the field of rotary mixing apparatus and more specifically to a combined rotary mixing and straining apparatus.

BACKGROUND OF THE INVENTION

As can be seen by reference to the following U.S. Pat. Nos.: 4,472,063; 4,332,482; 2,469,649; and, 2,518,196 the prior art is replete with myriad and diverse arrangements used to agitate, mix, and stir different liquids.

While all of the aforementioned prior art constructions are more than adequate for the basic purpose and function for which they have been specifically designed, these previously patented devices also share a uniform deficiency in their restricted and limited utilitarian usage outside of their own specialized and restrictive environment.

As a consequence of the foregoing situation there has existed a longstanding need in the mixing art for a universal apparatus that can be used to mix, agitate and strain a wide spectrum of diverse liquid environments such as paint, lumpy wall paper paste, septic wastes, etc.; and, the provision of such an apparatus is a stated objective of the present invention.

SUMMARY OF THE INVENTION

Briefly stated, the present invention comprises a powered mixing/straining apparatus including a rotary power unit, shaft unit and a mixing head unit.

The mixing head unit comprises a generally open cylindrical framework member which is operatively connected to the shaft unit such that the rotary power unit can impart rotational movement to the framework member in a well recognized fashion.

In addition, the mixing head unit further comprises a screen member that is operatively connected to the exterior surface of the generally cylindrical framework member; wherein, the framework member and the screen member combine to provide the mixing and agitating functions of the apparatus; while, the screen member acts as a spinning filter that recirculates the liquid in which the apparatus is employed to both break up oversized particles and to filter out unwanted contaminants suspended in the liquid.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is an exploded perspective view of a portion of one version of the preferred embodiment;

FIG. 2 is a perspective view of the two main components of the first version of the preferred embodiment;

FIG. 3 is a side plan view of the main components as they are about to be assembled;

FIG. 4 is a cross-sectional view of the shaft unit and the lower portion of the framework member;

FIG. 5 is a detail view depicting the cleansing of the filter member;

FIG. 6 is a perspective view of a portion of the second version of the preferred embodiment;

FIG. 7 is a perspective view of the shaft unit and the mixing head unit of the apparatus; and, FIG. 8 is a perspective view of the structural units that comprise the preferred embodiment in general.

BEST MODE FOR CARRYING OUT THE INVENTION

As can be seen by reference to the drawings and to FIG. 8 in particular, the rotary mixing and straining apparatus that forms the basis of the present invention is designated generally by the reference numeral (10). The apparatus (10) comprises in general: a rotary power unit (11); a shaft unit (12) and a mixing head unit (13). These units will now be described in seriatim fashion.

Still referring to FIG. 8 it can be seen that the rotary power unit (911) comprises a conventional rotary power tool (14) such as a rotary drill (15) or the like. In addition, the shaft unit (12) comprises an elongated shaft member (16) which is adapted to be operatively attached on one end (16') to a conventional rotary power tool (14) and operatively engaged on the other end (16'') to the mixing head unit (13) to stir, agitate, mix and strain a liquid (100) within a receptacle (101).

In the first version of the preferred embodiment of the mixing head unit (13) depicted in FIGS. 1 thru 5, 7 and 8, it can be seen that the mixing head unit (13) comprises a generally cylindrical framework member (20) and a generally cylindrical screen member (40) which is operatively engaged with the framework member (20).

Turning now to FIGS. 1 thru 4, it can be seen that in the first version of the preferred embodiment the framework member (20) comprises an upper body portion (21) and a lower base portion (22); wherein the upper body portion (21) comprises two half body sections (23) (25) provided with elongated fluid apertures (24). In addition, each of the body sections are provided with an enlarged upper generally smooth peripheral collar (26) and a reduced diameter externally threaded lower collar (27), whose purpose and function will be described presently. Furthermore each of the body sections (23) and (25) are provided with locking means (28) such that the body sections (23) and (25) can be joined together in the generally cylindrical configuration that is depicted in FIGS. 2, 3 and 8.

As can best be seen by reference to FIGS. 1 and 4, the lower base portion (22) of the framework member (20) comprises a base cap element (29) optionally provided with a transverse recess (30) in its bottom for receiving a wiper element (31); wherein, the base cap element (29) is further provided with a raised and internally threaded central portion (32) which is surrounded by internally threaded cylindrical walls (33).

Referring now to FIGS. 3 and 4, it can be appreciated that the threaded central portion (32) of the base cap element (29) is dimensioned to receive the threaded end (16'') of the shaft member (16) to form the operative engagement between the shaft unit (12) and the mixing head unit (13); while the internally threaded cylindrical walls (33) of the base cap element (29) are adapted to receive the externally threaded lower collar (27) of the body halves (23) and (25) of the upper split body portion (21) to join the upper (21) and the lower (22) portions of the framework member (20) together.

As shown in FIGS. 1 thru 3, the screen unit (13) comprises a generally open ended cylindrically configured screen member (40) fabricated from mesh screening (41) and optionally provided with reinforcing means

(42) such as a stiffening ring, or the like, to provide added strength and/or stiffness to the generally cylindrical configuration of the screen member (40). In addition, the screen member (40) is further provided with at least one notch (43) which is adapted to register with at least one complimentary protrusion (39) formed on the framework member (20) to prevent relative movement between the screen member (40) and the framework member (20) when they are in their assembled disposition.

It should be appreciated at this juncture that the mesh size of the screen member (40) will change depending upon the different types of liquid (100) with which the mixing head unit (13) is employed. In addition, in the event that the screen mesh becomes clogged with debris and contaminants, it is a simple matter to remove the screen member (40) from the framework member (20) such that the screen member (40) may be cleaned by a wire brush (50) or the like as depicted in FIG. 5.

It should further be appreciated that given the open cylindrical configuration of the top end of the mixing head unit (13) liquid (100) contained within the interior of the mixing head unit (13) will be expelled by centrifugal force through the screen mesh (41) and drawn back into the interior of the mixing head member through the top end of the cylindrical framework member (20) in accordance with well recognized fluid principals.

In addition, in those instances in which contaminants have settled to the bottom of the fluid receptacle (101), the wiper element (31) may be employed to resuspend the contaminants in the fluid (100) for subsequent removal by the filtering action produced by the screen member (40).

In the second version of the preferred embodiment depicted in FIG. 6, it can be seen that the generally cylindrical framework member (20') comprises a cylindrical core element (60) affixed to the shaft member (16) and provided with a plurality of radially disposed arm elements (61) which support and suspend a plurality of vertically disposed paddle elements (62) having fluid flow apertures (63); wherein, the paddle elements (62) roughly define a cylindrical configuration.

In this particular version the framework member (20') is surrounded by and rigidly affixed to a screen member (40'); and, the bottom of the framework member (20') may be left open or optionally provided with an apertured cap element (22') or a solid cap element (22'') depending on the amount of internal liquid recirculation is desired through the bottom of the mixing head unit (13') as depicted in FIG. 7.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A rotary mixing and straining apparatus for liquids confined in a receptable wherein the apparatus comprises:

a rotary power unit in the form of a conventional rotary power tool;

a shaft unit including a shaft member having a first end and a second end wherein said first end is adapted to be operatively engaged with said rotary power tool; and, a mixing head unit comprising a mixing head member including a generally cylindrical open framework member attached to the second end of the shaft member and a generally cylindrical screen member operatively attached to the outer periphery of the framework member wherein, the framework member comprises:

a cylindrical core element secured to the second end of the shaft member and provided with a plurality of radial arm elements which support and suspend a plurality of generally vertically disposed paddle elements in a generally cylindrical configuration; and wherein, each of the paddle elements are provided with fluid apertures.

2. The apparatus as in claim 1 wherein the bottom end cap element is provided with a plurality of apertures.

3. A rotary mixing and straining apparatus for liquids confined in a receptable wherein the apparatus comprises:

a rotary power unit in the form of a conventional rotary power tool;

a shaft unit including a shaft member having a first end and a second end wherein said first end is adapted to be operatively engaged with said rotary power tool; and, a mixing head unit comprising: a mixing head member including a generally cylindrical open framework member; a generally cylindrical screen member operatively attached to the outer periphery of the framework member; and a generally flat bottom end cap element operatively attached to both the framework member and the second end of the shaft member; wherein, the end cap element is further provided with a generally straight wiper element.

* * * * *